US005704067A

United States Patent [19]

Brady

[11] Patent Number: 5,704,067

[45] Date of Patent: Jan. 6, 1998

[54] EXERCISE ORGANIZER SWEATBAND

[76] Inventor: Philip Brady, 15951 E. 13th Pl., Aurora, Colo. 80011-7281

[21] Appl. No.: 792,042

[22] Filed: Jan. 31, 1997

[51] Int. Cl.[6] ..... A41D 20/00

[52] U.S. Cl. ..... 2/170; 40/586; 40/633; 224/219; 224/220; 273/DIG. 26; 116/222; 116/307

[58] Field of Search ..... 2/170, 311, 312, 2/60, 59, 244, 16, 246, 22, 66, 159, 161.1, 158, 181, 208, 917, 918, DIG. 11; 40/586, 1.5, 1.6, 299, 904, 304, 310, 316, 317, 321, 334, 625, 626, 630, 633, 5, 642.02, 644, 660, 661, 661.04, 661.05, 661.09, 768–776; 224/218, 219, 222, 267; 116/1, 223, 222, 224, 306, 307, 317; 273/287, 288, 148 A, 150, DIG. 26, 14, 30

[56] References Cited

U.S. PATENT DOCUMENTS

| | | | |
|---|---|---|---|
| 3,214,852 | 11/1965 | Ford et al. | 40/586 |
| 4,164,910 | 8/1979 | Feiler | 2/170 |
| 4,557,215 | 12/1985 | Petersson | 2/170 |
| 4,616,436 | 10/1986 | DeWoskin | 40/633 |
| 5,119,513 | 6/1992 | McKay | 2/170 |
| 5,170,917 | 12/1992 | Tourigny | 40/586 |
| 5,183,193 | 2/1993 | Brandell . | |
| 5,329,638 | 7/1994 | Hansen et al. | 2/170 |
| 5,386,933 | 2/1995 | Greene et al. . | |
| 5,400,936 | 3/1995 | Jones et al. . | |
| 5,454,185 | 10/1995 | Love . | |

*Primary Examiner*—Gloria Hale
*Attorney, Agent, or Firm*—Norman B. Rainer

[57] ABSTRACT

A sweatband adapted to be worn upon the wrist of a user during exercise activity is fabricated as a tubular elasticized band of water absorbent material having an external compliant pocket. A transparent window is centered in the pocket to permit visualization of cards insertable into the pocket and containing indicia related to the exercise activity. A border of attachment substrate is disposed about the perimeter of the pocket. First and second sets of markers are releasibly attached to the attachment substrate in a manner which can record the progress or status of the exercise activity.

3 Claims, 1 Drawing Sheet

EXERCISE ORGANIZER SWEATBAND

BACKGROUND OF THE INVENTION

1. Field of the Invention

This invention concerns a device for monitoring exercise performance, and more particularly relates to an exercise monitoring device which also serves as a wrist-worn sweatband.

2. Description of the Prior Art

The use of athletic sweatbands is well known. When worn on the wrists, they minimize migration of perspiration to the hands of the user. The perspiration would otherwise impair the user's ability to securely grasp objects such as a tennis racquet or other sports-related items.

Wrist-worn devices having compartments for holding various functional items are disclosed in U.S. Pat. Nos. 5,183,193 to Brandell; 5,386,933 to Greene et. al.; 5,400,936 to Jones et. al.; and 5,454,185 to Love. However, none of said patents relate to the monitoring of exercise activities.

Scorekeeping and record-keeping devices for use in monitoring sports performance are well known, ranging from writing devices to stopwatches and computers. Less numerous, however, are manually operable devices capable of keeping track of multiple activities over an extended time period ranging to six or seven days.

It is accordingly an object of the present invention to provide a wrist-worn sweatband useful in monitoring exercise activities.

It is a further object of this invention to provide a sweatband as in the foregoing object which is manually operable to keep track of multiple activities over an extended time period.

It is another object of the present invention to provide a sweatband of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a wrist-worn sweatband comprising:

a) a tubular elasticized band of water absorbent material elongated upon a central axis and bounded by inner and outer surfaces and upper and lower extremities, b) a pocket comprised of a compliant panel disposed upon said outer surface and elongated in the axial direction of said band, said panel having a transparent window portion and further defined by a perimeter comprised of four straight edges defining a rectangular contour, three of said edges being attached to said band, and the fourth edge being unattached and thereby constituting an opening for said pocket, c) a border of attachment substrate disposed about the perimeter of said panel, d) first and second sets of markers which are releasibly securable to said attachment material, the markers of each set being identical and numbering between 5 and 10, the markers of said first set being visibly different than the markers of said second set, and e) a set of cards containing informational indicia, said cards dimensioned to achieve close-fitting sliding insertion into said pocket.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
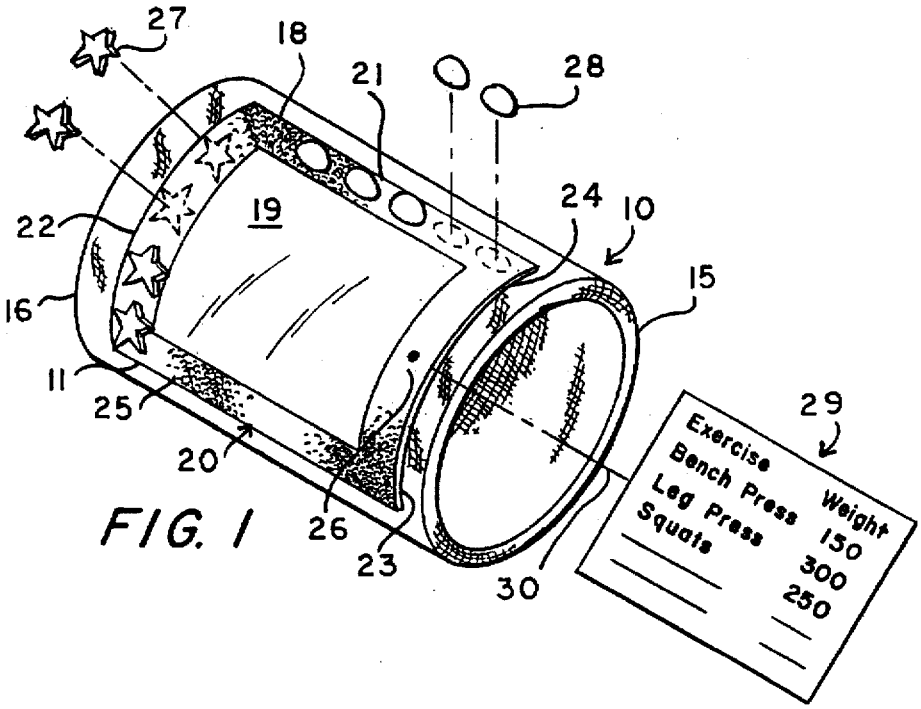
FIG. 1 is an exploded perspective view of an embodiment of the sweatband of the present invention.
Figure 2:
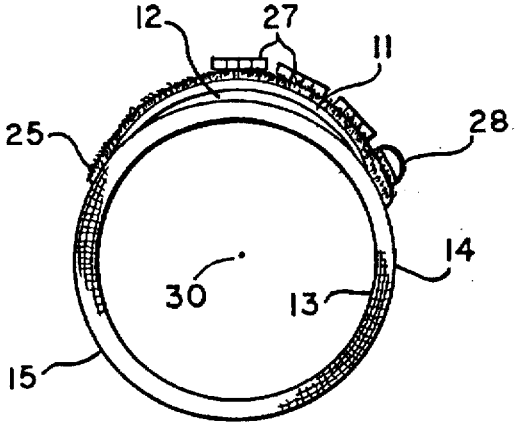
FIG. 2 is an end view taken from the right of FIG. 1.
Figure 3:
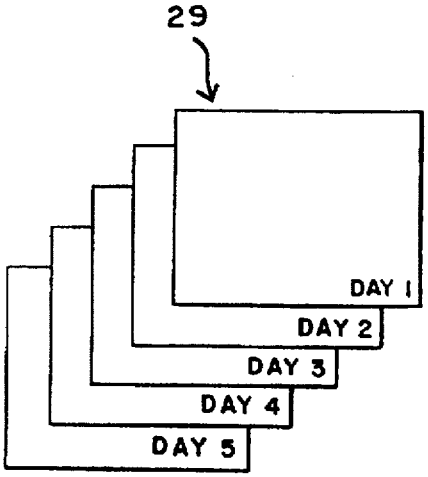
FIG. 3 illustrates a set of informational cards employed in the sweatband of FIG. 1.

Referring to FIGS. 1–3, an embodiment of wrist-worn sweatband of the present invention is shown comprised of tubular elasticized band 10 and panel 11 which forms a pocket 12 with said band.

Band 10 is comprised at least in part of elastomeric material such as spandex fiber, thereby enabling the band to securely engage the wearer's wrist. Band 10 is further comprised at least in part of water absorbent material such as fabrics containing cotton, or synthetic foam materials. Said band is elongated upon center axis 30, and is dimensioned to have a length/diameter ratio between about 1 and 3. Band 10 is bounded by inner and outer surfaces 13 and 14, respectively, and upper and lower extremities 15 and 16, respectively. When worn on the wrist, said extremities assume a substantially circular configuration.

Pocket 12 is disposed upon outer surface 14 and elongated in the axial direction of said band. Said pocket is comprised of a compliant panel 18 having a centered transparent window portion 19. Panel 18 is further defined by a perimeter 20 comprised of opposed long edges 21 and left and right short edges 22 and 23, respectively, said four edges defining a rectangular contour. In the illustrated embodiment, both long edges and the left short edge are attached to said band. The right short edge is unattached, and thereby constitutes an opening 24 for said pocket.

In alternative embodiments, different edges of said panel may provide the opening. A releasible closure mechanism such as a snap fastener 26 may be associated with opening 24 in a manner which does impair the effectiveness of said opening for the passage of objects entering and leaving pocket 12. The expression "compliant" is intended to designate materials that are supple, bendable and easily conformable to various shapes without necessarily being elastomeric. A typical compliant material suitable for use in fabricating panel 18 is a sheet of plasticized transparent polyvinyl chloride, said sheet having a thickness in the range of about 15 to 50 mils. Attachment of panel 18 to band 10 may be by way of sewing, adhesives or thermal bonding methods. In alternative embodiments pocket 12 may be pre-formed of two layers of compliant panel prior to attachment to the band.

A border of attachment substrate 25 is disposed upon panel 18 about the perimeter thereof. Preferred attachment substrate is hook and loop type attachment material commercially available under the trademark VELCRO from the Velcro Corporation of N.Y. Such hook and loop attachment or fastening material involves paired interactive members, each comprising a compliant base sheet having an upraised pile of synthetic fibers. The fibers of one member are in the form of loops. The fibers of the other interactive member are cut loops, which constitute hooks. When the two members of the fastening system are pressed together in face-to-face relationship, there is substantial engagement of hook fibers with loop fibers. A considerable effort must be applied to separate the members unless they are peeled apart, in which event the members are easily separated.

In alternative embodiments, the attachment substrate may be a contact-type releasible adhesive, or a strip of flexible magnetic material. Suitable strips of flexible magnetic material are available from Edmund Scientific Company of Barrington, N.J. The border of attachment substrate 25 preferably has a uniform width of between about ¼ inch and ½ inch. The primary advantage of utilizing VELCRO as the attachment substrate is that it enables the sweatband to be easily and repeatedly washed.

A first set of markers 27, shown having a star appearance, is shown releasibly secured to the attachment substrate adjacent left edge 22. A second set of markers 28, shown having an oval appearance, is shown releasibly secured to attachment substrate 25 adjacent upper long edge 21. Each marker has an underside that provides releasible engagement with the attachment substrate 25. For example, when VELCRO is employed as the attachment material, a piece of mating VELCRO is adhered to the underside of the marker. When magnetic strip material is utilized for attachment substrate, the markers may be of ferromagnetic material such as iron, or alternatively, a piece of ferromagnetic material or magnetic strip may be adhered to the underside of the marker.

When the sweatband of the present invention is utilized to monitor repetitive weight training exercise, the markers of the first set, shown having a star shape, may be employed to represent or designate the type of exercise, and the markers of the second set, shown having an oval shape, may be employed to represent or designate the number of repetitions of the exercise. To record the completion of the designated exercise, the markers are moved from a storage position on the border to a marking position on the border. Such movement is preferably from one edge to the opposite edge of the border, and serves to monitor the progress of the exercise activity.

A set of cards 29 is employed by the sweatband of the present invention. Each card contains informational indicia pertinent to a particular repetitive activity or daily exercise regimen. In the illustrated embodiment, the cards are adapted for use in weight training activities. Accordingly, the cards list the names of the exercises, the weight settings for each exercise, and the recommended number of repetitions for each exercise. Each card is dimensioned so as to achieve close-fitting sliding insertion into pocket 12.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A wrist-worn sweatband comprising:

a) a tubular elasticized band of water absorbent material elongated upon a central axis and bounded by inner and outer surfaces and upper and lower extremities, b) a pocket comprised of a compliant panel disposed upon said outer surface and elongated in the axial direction of said band, said panel having a transparent window portion and further defined by a perimeter comprised of four straight edges defining a rectangular contour, three of said edges being attached to said band, and the fourth edge being unattached and thereby constituting an opening for said pocket, c) a border of attachment substrate disposed about the perimeter of said panel, d) first and second sets of markers which are releasibly securable to said attachment substrate the markers of each set being identical and numbering between 5 and 10, the markers of said first set being visibly different than the markers of said second set, and e) a set of cards containing informational indicia, said cards dimensioned to achieve close-fitting sliding insertion into said pocket.

2. The sweatband of claim 1 wherein said attachment substrate is comprised of a component of hook and loop type attachment material and said markers have a reverse side with a mating hook and loop fastener component attached thereto for attachment to said substrate.

3. The sweatband of claim 1 further comprised of a releasible closure mechanism associated with the opening of said pocket.

* * * * *